US005277098A

United States Patent [19]

Lyon et al.

[11] Patent Number: 5,277,098

[45] Date of Patent: Jan. 11, 1994

[54] ON-OFF VALVE FOR HYDRAULIC ROCKDRILL

[75] Inventors: Leland H. Lyon, Roanoke; Thomas J. Mlasgar, Cloverdale, both of Va.

[73] Assignee: Ingersoll-Rand Company, Woodcliff Lake, N.J.

[21] Appl. No.: 902,225

[22] Filed: Jun. 22, 1992

[30] Foreign Application Priority Data

Apr. 29, 1992 [ZA] South Africa ..... 92/3131

[51] Int. Cl.[5] ..... F01L 25/02; F16K 5/00

[52] U.S. Cl. ..... 91/289; 251/180; 251/304

[58] Field of Search ..... 91/304, 309, 317, 321, 91/322, 462, 468, 289; 173/206, 207, 208; 251/176, 177, 180, 304, 310

[56] References Cited

U.S. PATENT DOCUMENTS

| | | | |
|---|---|---|---|
| 283,788 | 8/1883 | Johnson et al. | 251/180 |
| 914,407 | 3/1909 | Gold | 251/180 X |
| 1,106,002 | 8/1914 | Schlemmer | 251/180 X |
| 1,176,253 | 3/1916 | Schutt | 251/180 X |
| 1,315,741 | 9/1919 | Pranold | 251/180 X |
| 2,628,588 | 2/1953 | Mehler | 251/180 X |
| 2,893,430 | 7/1959 | Holl | 251/180 X |
| 3,677,516 | 7/1972 | Hicks | 251/304 X |
| 3,774,502 | 11/1973 | Arndt | 91/321 X |
| 4,142,447 | 3/1979 | Krasnoff et al. | 91/321 X |
| 4,425,835 | 1/1984 | Krasnoff | 91/317 |
| 4,631,005 | 12/1986 | Warren et al. | 417/218 |
| 4,966,186 | 10/1990 | Rodstein | 251/304 X |

FOREIGN PATENT DOCUMENTS

| | | | |
|---|---|---|---|
| 481533 | 3/1938 | Great Britain | 251/177 |
| 812586 | 9/1951 | Fed. Rep. of Germany | 251/180 |
| 437761 | 7/1948 | Italy | 251/180 |
| 75/0977 | 12/1975 | South Africa . | |
| 75/1716 | 1/1976 | South Africa . | |
| 75/3497 | 7/1976 | South Africa . | |
| 75/6779 | 8/1976 | South Africa . | |
| 75/6798 | 9/1976 | South Africa . | |
| 76/0374 | 3/1977 | South Africa . | |
| 75/6923 | 3/1977 | South Africa . | |
| 78/4702 | 7/1977 | South Africa . | |
| 76/5402 | 7/1977 | South Africa . | |
| 76/3555 | 8/1977 | South Africa . | |
| 77/1430 | 1/1978 | South Africa . | |
| 77/2372 | 5/1978 | South Africa . | |
| 77/4591 | 5/1978 | South Africa . | |
| 77/3296 | 7/1978 | South Africa . | |
| 77/6530 | 7/1978 | South Africa . | |
| 78/4701 | 11/1978 | South Africa . | |
| 78/4703 | 11/1978 | South Africa . | |
| 78/2588 | 3/1979 | South Africa . | |
| 78/3620 | 6/1979 | South Africa . | |
| 78/1854 | 7/1979 | South Africa . | |
| 78/4253 | 10/1979 | South Africa . | |
| 78/3580 | 12/1979 | South Africa . | |
| 79/2197 | 3/1980 | South Africa . | |
| 79/2711 | 5/1980 | South Africa . | |
| 79/5945 | 9/1980 | South Africa . | |
| 80/7171 | 7/1981 | South Africa . | |

(List continued on next page.)

*Primary Examiner*—Edward K. Look
*Assistant Examiner*—John Ryznic
*Attorney, Agent, or Firm*—John J. Selko

[57] ABSTRACT

An on-off valve is provided for a rockdrill which is operable by a hydraulic fluid under pressure and which is controlled by a hydraulically biassed valve. The rockdrill is turned on and off by opening and closing the on-off valve. When the valve is turned off hydraulic pressure from an inlet line and a supply pin line to a valve line of the hydraulically biassed control valve is cut off, thereby eliminating the pressure on the supply pin. This interrupts the operating cycle of the control valve and thereby shuts off the operation of the hydraulic drill. When the on-off valve is opened the hydraulic pressure from the inlet line via the supply pin line is re-established to the valve line and to the supply pin, and the operating cycle of the control valve is re-established.

6 Claims, 2 Drawing Sheets

FOREIGN PATENT DOCUMENTS

| | | |
|---|---|---|
| 80/8017 | 1/1982 | South Africa . |
| 81/2479 | 6/1982 | South Africa . |
| 81/5936 | 7/1982 | South Africa . |
| 81/5767 | 9/1982 | South Africa . |
| 82/2939 | 1/1983 | South Africa . |
| 82/5127 | 3/1983 | South Africa . |
| 81/7567 | 5/1983 | South Africa . |
| 82/6507 | 6/1983 | South Africa . |
| 82/7447 | 8/1983 | South Africa . |
| 83/0045 | 9/1983 | South Africa . |
| 83/0744 | 9/1983 | South Africa . |
| 82/3823 | 12/1983 | South Africa . |
| 83/7941 | 5/1984 | South Africa . |
| 83/7942 | 5/1984 | South Africa . |
| 84/2140 | 10/1984 | South Africa . |
| 84/3054 | 10/1984 | South Africa . |
| 83/3953 | 12/1984 | South Africa . |
| 84/9716 | 7/1985 | South Africa . |
| 85/8129 | 9/1986 | South Africa . |
| 85/8751 | 6/1986 | South Africa . |
| 86/0046 | 7/1986 | South Africa . |
| 86/1842 | 9/1986 | South Africa . |
| 85/4503 | 12/1986 | South Africa . |
| 85/4504 | 12/1986 | South Africa . |
| 87/1642 | 9/1987 | South Africa . |
| 87/6751 | 9/1987 | South Africa . |
| 87/9722 | 9/1987 | South Africa . |
| 87/2338 | 10/1987 | South Africa . |
| 89/5716 | 2/1990 | South Africa . |
| 89/6704 | 4/1990 | South Africa . |
| 90/7692 | 5/1991 | South Africa . |
| 90/10035 | 9/1991 | South Africa . |
| 91/2041 | 10/1991 | South Africa . |
| 91/4522 | 1/1992 | South Africa . |
| 91/5152 | 2/1992 | South Africa . |

ON-OFF VALVE FOR HYDRAULIC ROCKDRILL

BACKGROUND OF THE INVENTION

This invention relates generally to rockdrills. More particularly the invention relates to an on-off valve for a hydraulic rockdrill which is operable by a hydraulic fluid under pressure and which is controlled by a hydraulically biassed valve.

Presently known hydraulic handheld rockdrills typically use a throttle valve for on and off and power regulating functions. The throttle valve is adjusted by the operator by turning a lever that opens and closes a port supplying fluid to the drill. Because the throttle valve port carries all the flow which powers the drill it must be fairly large, usually in the order of 7/16 to ½ inch to 11.11 to 12.7 mm) in diameter. When operating at high pressure, as most hydraulic drills do, the handle torque required to operate the valve becomes excessive making the handle difficult to turn. This is primarily due to friction created by the large force imbalance across the valve port. Due to the stiffness of the handle, many operators often do not turn the drill off between holes and thus accumulate unproductive running time on drill cmponents. Additionally, the complexity and number of parts associated with a throttle valve assembly add cost and decrease the reliability of a rockdrill.

The foregoing illustrates limitations known to exist in present handheld hydraulic rockdrills. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

Improved handle operability, increased simplicity and reduced manufacture cost have been achieved in the present invention by providing a pilot operated on-off valve. Rather than interrupt the main fluid passage way to the drill as in the presently known art, a valve which controls a smaller port is disclosed. The smaller port, approximately ⅛ inch 3.175 mm) in diameter, which is opened and closed by the on-off valve, controls a valve function which operates the drill. When the port is open the valve is operable, when the port is closed the valve will not operate. Because the port being controlled is smaller than that of the presently known art, the valve requires less force and is therefore easier to operate.

According to the invention there is provided an on-off valve for shutting on and off the operation of a rockdrill operable by a hydraulic fluid under pressure and controlled by a hydraulically biassed valve, the on-off valve including:

connecting means for connecting the valve in series between a supply of hydraulic fluid under pressure and a hydraulically biassed control valve for controlling a hydraulically operable rockdrill;

means defining a chamber in the valve for providing communication between the supply of hydraulic fluid under pressure and the control valve; and a valve closure member in the chamber displaceable between one position in which communication is established between the supply of hydraulic fluid under pressure and the control valve and another position in which the communication is interrupted.

The connecting means may include a first conduit means establishing communication between the on-off valve and a supply of hydraulic fluid under pressure, and a second conduit means establishing communication between the on-off valve and the control valve.

The means defining a chamber may include:

a housing;

a displaceable valve stem;

a bearing; and a gland.

The valve closure member may include:

a displaceable valve stem;

a seal element on the valve stem for closing off the flow of hydraulic fluid under pressure to the control valve; and biassing means for biassing the seal element to a closed position.

The valve stem may be rotatably displaceable, and the seal element may be slideably displaceable into and away from a closed position by rotatingly displacing the valve stem.

The biassing means may include a hydraulic fluid under pressure and, or alternatively, a spring.

BRIEF DESCRIPTION OF THE DRAWING FIGURES

DETAILED DESCRIPTION

Figure 1:
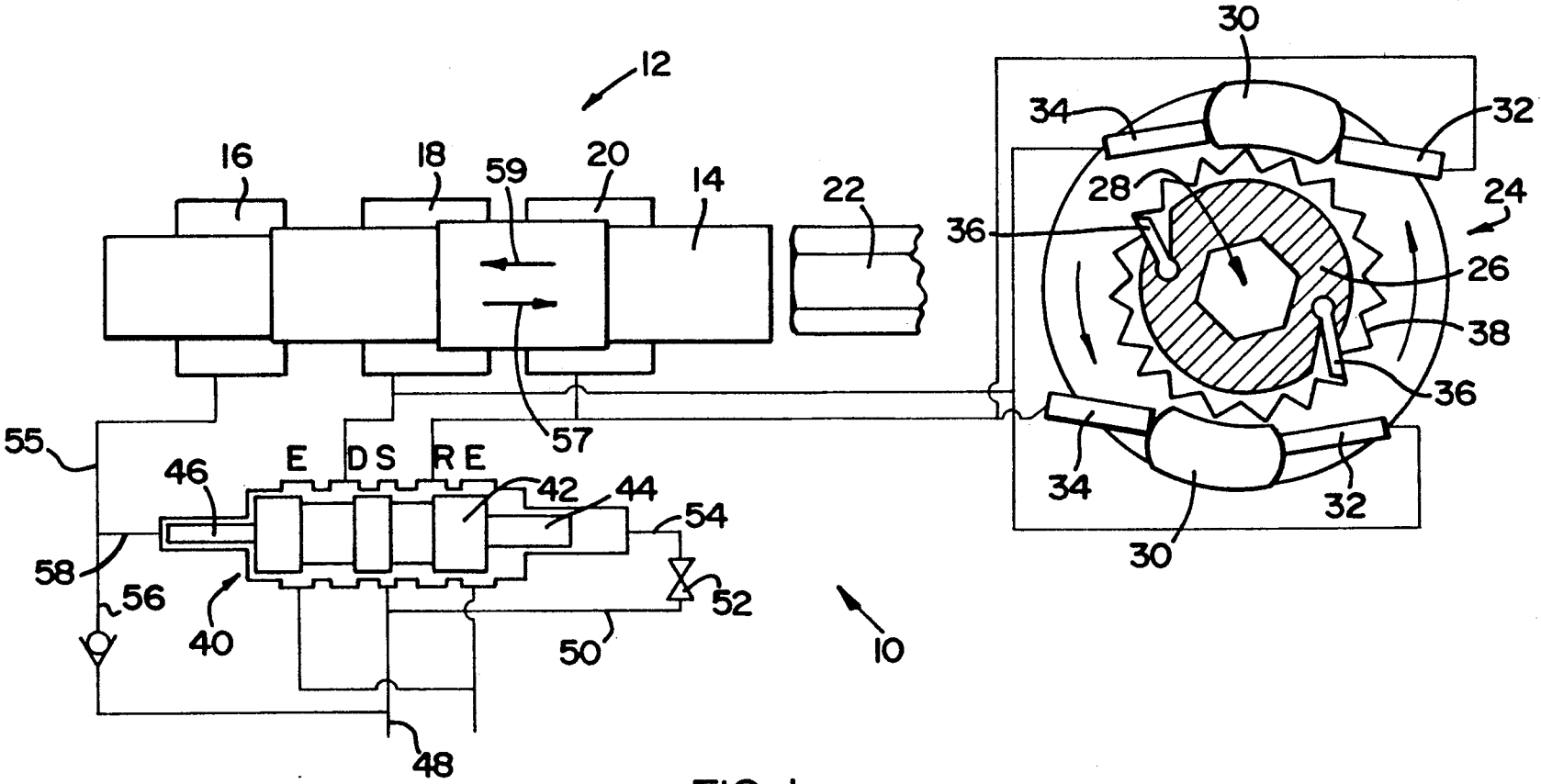
FIG. 1 shows diagrammatically an on-off valve in accordance with the invention included in the hydraulic control circuit for a hydraulic rockdrill.

Referring to the drawings, FIG. 1 shows diagrammatically by reference numeral 10 a hydraulic circuit for controlling the operation of a rockdrill indicated diagrammatically by reference numeral 12. The rockdrill 12 includes a piston 14 and various operating chambers namely a cushion chamber I6, and drive chamber 18 and a return chamber 20. A drill stem is indicated by reference numeral 22. The rockdrill 12 further includes a mechanism indicated generally and diagrammatically by reference numeral 24 for rotating the drill stem 22. The mechanism includes a chuck 26 having a bore 28 for receiving the drill stem 22. The mechanism further includes a rotor 30, index plungers 32 and reset plungers 34, both hydraulically operable by the hydraulic circuit 10. Pawls 36 engaging a ratchet 38 effect the rotation of the chuck 26 when the rotor 30 is turned.

The hydraulic circuit 10 includes a hydraulically biassed control valve 40 for contoolling the operation of the rockdrill 12. The control valve 40 includes a spool valve 42, a supply pin 44, a cushion pin 46 and an arrangement of ports E (exhaust), D (drive), S (supply) and R (return). The control valve 40 is hydraulically connected in the circuit 10 to the chambers 16, 18 and 20, and to the index plungers 32 and to the reset plungers 34 of the mechanism 24.

A large diameter hydraulic pressure inlet line 48 communicates with a supply pin line 50. The supply pin line 50 feeds hydraulic pressure to the on-off valve 52 which is interposed between the supply pin line 50 and a valve line 54. By operating the on-off valve 52 the flow of hydraulic pressure from the supply pin line 50 to the valve line 54 can be interrupted. It can therefore be seen that the hydraulic pressure on the supply pin 44 is dependent on the on-off valve 52 being open or closed.

The hydraulically biassed control valve 40 is operated by feeding hydraulic pressure from the inlet line 48 via the line 50, the on-off valve 52 and the line 54 to the supply pin 44, and via the lines 56 and 58 to the cushion pin 46. The operating cycle of the control valve includes out of balance hydraulic forces operating on the supply pin 44 and on the cushion pin 46 which cause the spool valve 42 to shuttle to and fro between the supply pin and the cushion pin, thereby operating the ports E, D, S and R and thereby the cushion chamber 16, the drive chamber I8 and the return chamber 20, and thereby causing the piston 14 of the hydraulic drill 12 to be reciprocated. Briefly described, the operating cycle is as follows: the piston 14 is provided with a cushion pressure surface which is continuously subjected to the pressure in the cushion chamber 16. The axial position of the piston cushion pressure surface controls the cushion pressure. The spool valve 42 is also continuously subjected to the force exerted by the cushion chamber pressure acting on the cushion pin 46 via lines 55 and 58 and includes surfaces subjected to the operating pressure and exhaust pressure. As the piston I4 moves in the direction of arrow 57, the cushion chamber pressure and therefore the force exerted against the spool valve 42 is decreased. When a predetermined differential force exists, the spool valve 42 is shifted to its second position to permit the application of hydraulic fluid against the piston 14 to reverse the direction of movement of the piston. As the piston thereafter moves in the direction of arrow 59 the cushion chamber pressure continuously increases. When the differential force reaches a predetermined amount, the spool valve 42 is then shifted to its first position. The cycle is continuously repeated as long as the hydraulically biassed control 40 is being operated. A more detailed description of the operating cycle of a valve similar to control valve 40 is given in U.S. Pat. No. 4,142,447 and in its equivalent ZA 75/6923. The invention is, however, not restricted to a control valve 40 as shown in FIG. I, but can be applied to any rockdrill using a valve member with a hydraulically biassed valve.

Referring further to FIG. 1, the rockdrill 12 is turned on and off by opening and closing the on-off valve 52. When the valve 52 is turned off the hydraulic pressure from the inlet line 48 and the supply pin line 50 to the valve line 54 is cut off, thereby eliminating the pressure on the supply pin 44. This interrupts the operating cycle of the control valve 40 and thereby shuts off the operation of the hydraulic drill 12. When the valve 52 is opened the hydraulic pressure from the inlet line 48 via the supply pin line 50 is re-established to the valve line 54 and to the supply pin 44, and the operating cycle of the control valve 40 is re-established.

Figure 2:
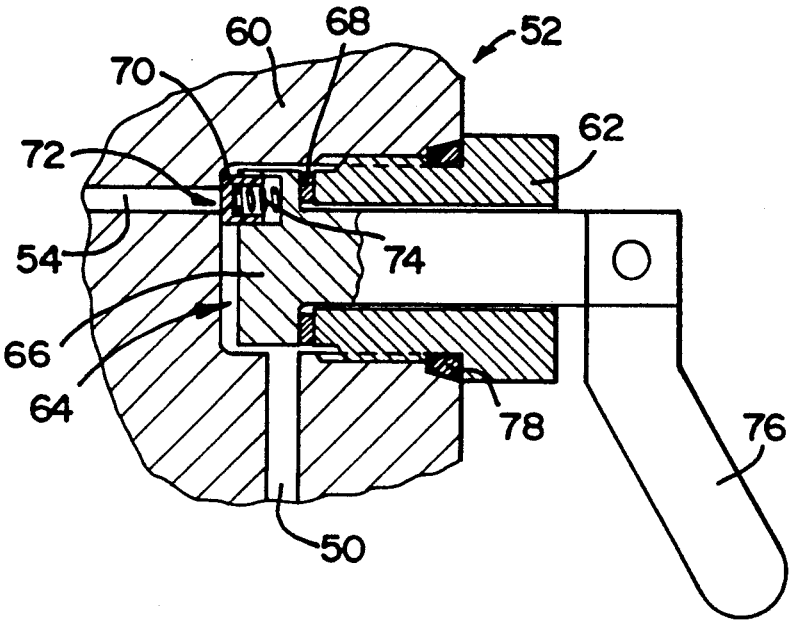
FIG. 2 is a longitudinal sectional view of the on-off valve included in the hydraulic circuit shown in FIG. 1.

Referring to FIG. 2, there is shown a longitudinal section in the "off" position of the on-off valve 52 shown in FIG. 1. The valve 52 includes the housing 60 of the rockdrill I2 shown diagrammatically in FIG. 1. The valve 52 further includes a threaded gland 62. Hydraulic pressure from the supply line 50 enters a chamber 64 defined in the valve 52 and loads a valve stem 66 against a bearing 68 and the gland 62. Pressure from the supply line 50 also pressurises a seal element 70 against a port 72 to the valve line 54. A spring 74 also biasses the seal element 70 against the port 72 when pressure is not present in the chamber 64. A handle 76 is provided on the valve stem 66 so that the valve stem can be rotatably displaced. Since the seal element 70 is located in the valve stem 66, it is slideably displaced onto and away from the port 72 when the valve stem 66 is rotated by turning the handle 76. A ring seal 78 is provided as an additional seal between the drill housing 60 and the gland 62.

Figure 3:
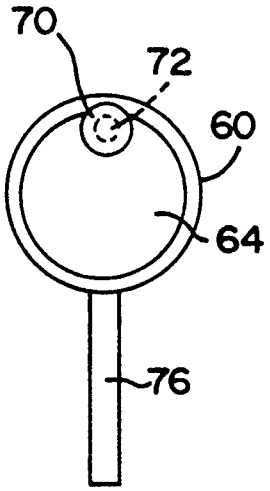
FIG. 3 shows diagrammatically the on-off valve of FIG. 2 in a closed position.

Referring to FIG. 3, there is shown diagrammatically an axial view of the seal element 70 positioned over the port 72 in the valve line 54 leading to the supply pin 44. In this position hydraulic pressure flow is prevented from pressurising the supply pin 44. A pressure differential between the valve chamber 64 and the supply pin port 72 creates an axial force on the seal element 70, together with the biassed spring 74, and thereby sealingy prevents hydraulic pressure to flow from the line 50 to the line 54 and to the supply pin 44. In this position the rockdrill 12 is therefore shut off.

Figure 4:
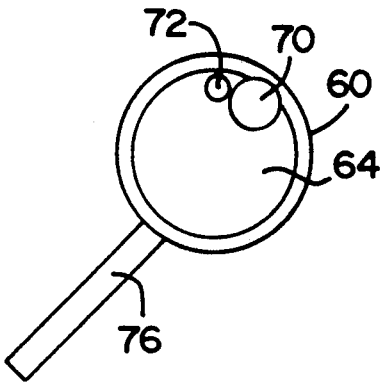
FIG. 4 shows diagrammatically the on-off valve of FIG. 2 in an open position.

Referring to FIG. 4, the handle 76 is shown rotated to the point where the seal element 70 slides off the port 72. Hydraulic pressure is able to pressurise the supply pin 44 and the rockdrill 12 becomes operational.

The on-off valve 52 of the invention has several advantages. It requires less force to operate than a throttle valve. Futhermore, it requires no grinding and expensive machining operations. Still further, it contains about half the parts of a throttle valve of the presently known art. Still further, due to the axial assembly of the on-off valve, repair and inspection are easily accomplished.

Having described the invention, what is claimed is:

1. An on-off valve for shutting on and off an operation of a rockdrill operable by a hydraulic fluid under pressure and controlling by a hydraulically biassed valve, the on-off valve including:

connecting means for connecting the valve in series between a supply of hydraulic fluid under pressure and a hydraulically biassed control valve for controlling a hydraulically operable rockdrill;

means defining a chamber in the valve for providing communication between the supply of hydraulic fluid under pressure and the control valve;

a valve closure member in the chamber displaceable between one position in which communication is established between the supply of hydraulic fluid under pressure and the control valve and another position in which the communication is interrupted;

a seal element on the valve stem for closing off the flow of hydraulic fluid under pressure to control the valve;

the closure member including a rotatable valve stem, the stem being axially displaceable away from said seal element by hydraulic lfuid under pressure;

biassing means for biassing the seal element to a closed position.

2. A valve as claimed in claim 1, in which the connecting means includes:

a first conduit means establishing communication between the valve and a supply of hydraulic fluid under pressure; and a second conduit means establishing commmunication between the valve and the control valve.

3. A valve as claimed in claim 1, in which the biassing defining a chamber includes;

a housing; and the displaceable valve stem.

4. A valve as claimed in claim 1, in which the means defining a chamber includes:

a bearing; and a gland.

5. A valve as claimed in claim 4, in which the biassing means includes:

hydraulic fluid under pressure.

6. A valve as claimed in claim 4, in which the biassing means includes:

a spring.

* * * * *